US006871799B2

(12) United States Patent
Tsutsui

(10) Patent No.: US 6,871,799 B2
(45) Date of Patent: Mar. 29, 2005

(54) GAS INJECTION VALVE AND FILLING JIG USED FOR FILLING GAS

(75) Inventor: Tatsuo Tsutsui, Atsugi (JP)

(73) Assignee: Bio Actis Limited, Tokyo (JP)

( * ) Notice: Subject to any disclaimer, the term of this patent is extended or adjusted under 35 U.S.C. 154(b) by 136 days.

(21) Appl. No.: 10/415,976

(22) PCT Filed: May 2, 2002

(86) PCT No.: PCT/JP02/04395

§ 371 (c)(1),
(2), (4) Date: May 6, 2003

(87) PCT Pub. No.: WO02/092467

PCT Pub. Date: Nov. 21, 2002

(65) Prior Publication Data

US 2004/0112923 A1 Jun. 17, 2004

(30) Foreign Application Priority Data

May 10, 2001 (JP) ..... 2001-139520

(51) Int. Cl.[7] ..... B05B 7/32

(52) U.S. Cl. ..... 239/337; 239/533.13; 222/402.2; 222/394; 222/402.16

(58) Field of Search ..... 239/533.15, 337, 239/340, 573; 222/394, 402.1, 402.16, 402.2, 494, 495, 496, 492; 137/536, 538

(56) References Cited

U.S. PATENT DOCUMENTS 4,863,073 A 9/1989 Burt et al.
6,145,712 A * 11/2000 Benoist ..... 222/402.1
6,202,900 B1 * 3/2001 Tsutsui et al. ..... 222/402.2
6,454,140 B1 * 9/2002 Jinks ..... 222/402.2

FOREIGN PATENT DOCUMENTS

| | | |
|---|---|---|
| EP | 0350369 | 6/1989 |
| JP | 53-38886 | 9/1978 |
| JP | 3-32957 | 3/1991 |
| JP | 06-345159 | 12/1994 |
| JP | 7-32462 | 7/1995 |
| JP | 07-251884 | 10/1995 |
| JP | 2509521 | 6/1996 |
| JP | 2001-328689 | 11/2001 |
| WO | 99/06303 | 2/1999 |
| WO | 99/30986 | 6/1999 |
| WO | 99/54230 | 10/1999 |

* cited by examiner

*Primary Examiner*—Dinh Q. Nguyen
(74) *Attorney, Agent, or Firm*—Crowell & Moring LLP

(57) ABSTRACT

A gas spray valve permits easy recharging of gas containers after use. The gas spray valve is of considerable strength and rigidity and can be manufactured in a less costly manner. One of the openings of a gas conduit of a valve pin is positioned so that, when the pin is in the raised position, the opening is positioned above a second seal ring and, when the valve pin is pushed into a first stop position, the opening is positioned below the second seal ring. A gas supply passage is provided that connects the interior of a gas container with a metering chamber on the inside of a first seal ring only when the valve pin is in the raised position. When the valve pin is in the raised position. When the valve pin is pushed into a second stop position, the opening of the gas conduit is positioned below the first seal ring so that the interior of the gas container communicates with the gas conduit. This permits recharging of the gas container with the gas.

4 Claims, 8 Drawing Sheets

GAS INJECTION VALVE AND FILLING JIG USED FOR FILLING GAS

TECHNICAL FIELD

The present invention relates to a gas spray valve for spraying contents of a gas container with the help of high-pressure gas as a propellant, such as liquid carbon dioxide, and more particularly, to an improved gas spray valve that permits reuse of gas containers.

BACKGROUND ART

One type of spray apparatus has traditionally been used that operates by spraying the contents of a gas container, such as a medical agent, with the help of high-pressure gas loaded in the container together with the contents. In such spray apparatuses, the gas is sprayed through a gas spray valve secured to an opening portion of the gas container. These spray apparatuses use certain types of chlorofluorocarbons as the propellant. In view of recent concerns about environmental protection, however, newly developed spray apparatuses that make use of HFC-134a, an alternative to chlorofluorocarbon, are becoming increasingly common in the marketplace.

Although HFC-134a has substantially no effects on the ozone layer, it has a significant impact on the global warming, 1000 times more significant than the impact of $CO_2$, or even worse. Therefore, a future increase in the use of HFC-134a is expected to pose a new problem. For this reason, it is proposed to use other propellants for spray apparatuses that have less effects on the ozone layer destruction or global warming, including carbon dioxide, gaseous nitrogen, and inert gases such as helium, neon, krypton, xenon, and radon.

It is desired that these gases, as with the hydrofluorocarbons currently in use, be liquefied when used as a propellant for use in spray apparatuses in order to make the gas container small. For example, liquid carbon dioxide has a vapor pressure of 60 kgf/cm$^2$ at 20° C. It is also preferred in terms of volume efficiency that the inert gases also be highly pressurized or liquefied and thus be put under a pressure of 50 kgf/cm$^2$ or greater.

Handling such high-pressure gases requires a specially designed gas spray valve, such as the one described in Japanese Patent Laid-Open Publication No. Hei 8-141450.

As shown in FIG. 7, this gas spray valve includes a valve case 2 secured to an opening portion 1*a* of a gas container 1 and a valve pin 3 slidably received in the valve case 2. A first seal ring 4 and a second seal ring 5 are arranged within the valve case 2 and are axially spaced apart from each other. A metering chamber 6 is formed between the seal rings 4 and 5 for trapping a predetermined amount of the gas prior to spraying. The valve pin 3 includes on the lower end thereof a first valve portion 7 that comes into close contact with the first seal ring 4 when the valve pin 3 is pushed in from the outside. The valve pin 3 also includes on the upper end thereof a second valve portion 8. The second valve portion 8 consists of a large portion 8*a* that comes into close contact with the second seal ring 5 when the valve pin 3 is in its upper position and a small portion 8*b* that defines a gap together with the second seal ring 5 when the valve pin 3 has been pushed in from the outside. The metering chamber accommodates a spring 9, which always urges the valve pin 3 upward.

When the gas spray valve constructed in the above-described manner is in its steady state without the valve pin 3 being pushed from the outside, the first valve portion 7 is apart from the first seal ring 4 with the large portion 8*a* of the second valve portion 8 remaining in close contact with the second seal ring 5, such that the interior of the gas container 1 remains in communication with the metering chamber 6. As the valve pin 3 is pushed in from the outside, the first valve portion 7 comes into close contact with the first seal ring 4, followed by formation of a gap between the small portion 8*b* of the second valve portion 8 and the second seal ring 5. The gap allows the contents of the gas container 1 to pass through along with the gas. The contents and the gas are then sprayed out from the gas container 1. Since formation of the gap between the second valve portion 8 and the second seal ring 5 is immediately preceded by the first valve portion 7 coming into close contact with the first seal ring 4 to close communication between the metering chamber 6 and the interior of the gas chamber 1, a predetermined amount of the mixture of the gas and the contents trapped in the metering chamber 6 is sprayed from the gas spray valve.

A construction of gas spray valve that permits reuse of the gas container and the gas spray valve is described in Japanese Patent Laid-Open Publication No. Hei 11-301759. As shown in FIG. 8, the gas spray valve 10 includes a valve case 12 secured to an opening portion 11*a* of a gas container 11 and a valve pin 13 slidably received in the valve case 12. Arranged within the valve case 12 are a first seal ring 18, which comes into close contact with the outer surface of the valve pin 13 at a first position relatively close to the center of the gas container 11, and a second seal ring 19, which comes into close contact with the outer surface of the valve pin 13 at a second position relatively far from the center of the gas container 11. A metering chamber 21 is defined within the valve case 12 between the first seal ring 18 and the second seal ring 19 for trapping a predetermined amount of gas prior to spraying. The valve pin 13 includes a gas conduit 22, which extends through the valve pin 13 from the top end thereof positioned outside the gas container 11 and opens in the outer periphery of the valve pin 13 at a position axially apart from the top end. The opening of the gas conduit 22 on the outer periphery of the valve pin 13 is arranged such that it is positioned above the second seal ring 19 when the valve pin 13 is in its raised position and it is positioned below the second seal ring 19 within the metering chamber 21 when the valve pin 13 is pushed down to a first stop position or further to a second stop position at which the valve pin stops during its two-step action. The valve pin 13 further includes a first bypass portion and a second bypass portion that, together with the inner surface of the first seal ring 18, form a gap when the valve pin 13 is in the raised position and in the second stop position, respectively, so that the interior of the gas container 11 communicates with the metering chamber 21 through this gap.

When the valve pin 13 is in the raised position in the gas spray valve of the above-described construction, the opening of the gas conduit 22 on the outer periphery of the valve pin 13 is positioned above the second seal ring 19. As a result, communication between the gas conduit 22 and the metering chamber 21 is closed, whereas the metering chamber 21 remains in communication with the interior of the gas container 11 through the first bypass portion of the valve pin 13. When the valve pin 13 is pushed into the first stop position, the first seal ring 18 closes communication between the gas container 11 and the metering chamber 21, and the opening of the gas conduit 22 on the outer periphery of the valve pin 13 is positioned within the metering chamber 21. As a result, the predetermined amount of the gas trapped in the metering chamber 21 is sprayed out from the gas container 11 through the gas conduit 22. When it is desired to injector refill the gas into the gas container 11, a gas injector is connected to the valve pin 13 and the valve pin 13 is pushed into the second stop position. This causes the opening of the gas conduit 22 on the outer periphery of the valve pin 13 to move into the metering chamber 21 and brings the metering chamber 21 into communication with the interior of the gas container 11 through the second bypass portion of the valve pin 13. As a result, the gas is injected from the gas injector, through the metering chamber 21 and the second bypass portion, into the gas container 11.

When a high-pressure gas such as liquid carbon dioxide is used as a propellant for the spray apparatus, the gas container and the gas spray valve must be of considerable strength to ensure safety. To this end, more materials need to be used to construct the gas container and the gas spray valve as compared to the conventional spray apparatus, which utilizes chlorofluorocarbon propellant. Accordingly, it is not desirable, in view of efficient use of resources, to make the spray apparatus disposable, which is the case with conventional spray apparatuses. Nevertheless, the above-mentioned gas spray apparatus described in Japanese Patent Laid-Open Publication No. Hei 8-141450 does not incorporate any structure that permits recharging of the gas container with the gas and contents, and therefore, the gas containers and the gas spray valves of these gas spray apparatuses must be discarded after use.

Accordingly, it is an objective of the present invention to provide a novel gas spray valve, which is not only simpler, stronger and more durable than conventional spray valves, but also has a structure suitable for industrial production while permitting recharging of the gas container after use, and thus, efficient use of natural resources, without leading to increased production costs. It is another objective of the present invention to provide an injection adapter for use with the gas spray valve that facilitates recharging of the gas.

In general, the nozzle of the gas spray valve must be pushed into when acted upon by a force of 3 kgf or less so that the gas spray valve can be manipulated with hands and fingers. When a high-pressure gas such as liquid carbon dioxide is used as a propellant for the spray apparatus, the magnitude of the force required to push the nozzle is proportional to the cross-sectional area of the valve pin upon which the pressure of the high-pressure gas is exerted. For this reason, the diameter of the valve pin is preferably Φ2.5 or less when liquid carbon dioxide propellant is used. Although valve pins with a larger diameter may be used by employing a spring or the like to reduce the force required to push the nozzle, the use of a spring makes the structure of the spray valve complex and leads to increased production costs.

With the diameter of Φ2.5 or less, the valve pin as disclosed in Japanese Patent Laid-Open Publication No. Hei 11-301759 may become susceptible to bending or breaking when subjected to a larger force due to its reduced strength and rigidity, which results from the v-shaped groove formed to serve as a bypass for allowing the gas into the metering chamber or for permitting recharging of the gas container with the gas and desired contents. This can lead to faulty operation or malfunction of the spray apparatus.

In addition to the gas conduit for allowing the gas and the contents to be sprayed out, the valve pin includes the two V-shaped grooves. Working such a valve pin involves complicated processes that require use of various tools.

Furthermore, the gas spray valve includes in the portion to receive the valve pin two grooves to receive respective seal rings and another groove to serve as the metering chamber. Since the valve pin has a diameter of Φ2.5 or less as described above, the size of the bore for receiving the valve pin is correspondingly small. In practice, it is difficult to form the grooves through the relatively small bore. For this reason, the structure of the gas spray valve is not suitable for industrial production.

DISCLOSURE OF THE INVENTION

In order to accomplish the objects, according to the invention as claimed in claim 1, a gas spray valve includes a valve case secured to an opening portion of a gas container; a valve pin slidably received in the valve case; a first seal ring and a second seal ring arranged within the valve case, the first seal ring coming into close contact with an outer periphery of the valve pin at a first position that is relatively close to the center of the gas container and the second seal ring coming into close contact with the outer periphery of the valve pin at a second position that is relatively far from the center of the gas container; and a metering chamber formed between the first seal ring and the second seal ring to trap a predetermined amount of gas prior to spraying. The gas spray valve is configured such that the valve pin includes a gas conduit extending therethrough from a top end thereof that is positioned outside the gas container to a point on an outer periphery thereof that is axially apart from the top end, with an opening of the gas conduit on the outer periphery of the valve pin being arranged such that it is positioned above the second seal ring when the valve pin is in its raised position, it is positioned below the second seal ring within the metering chamber when the valve pin is pushed into a first stop position, and it is positioned below the first seal ring within the gas container when the valve pin is pushed into a second stop position. The valve pin further includes a gas supply passage extending from a bottom end thereof that is positioned within the gas container to a point on the outer periphery that is axially apart from the bottom end. One of the openings of the gas supply passage that is on the outer periphery of the valve pin is arranged such that, when the valve pin is in the raised position, it is positioned above the first seal ring within the metering chamber to open communication between the interior of the gas container and the metering chamber.

The present invention is such that, when the valve pin is in its raised position, the opening of the gas conduit on the outer periphery of the valve pin is positioned above the second seal ring to close communication between the gas conduit and the metering chamber, and the opening of the gas supply passage on the outer periphery of the valve pin is positioned above the first seal ring within the metering chamber to maintain communication between the metering chamber and the interior of the gas container. When the valve pin is pushed into the first stop position, the first seal ring closes communication between the interior of the gas container and the metering chamber while the opening of the gas conduit on the outer periphery of the valve pin moves into the metering chamber. As a result, the predetermined amount of the gas trapped in the metering chamber is sprayed out from the gas container through the gas conduit.

Upon injection of the gas into the gas container, the valve pin is connected to a gas injector and is pushed into the second stop position. This causes the opening of the gas conduit on the outer periphery of the valve pin to move into the interior of the gas container, allowing the gas to flow from the gas injector into the gas container.

In the valve pin in accordance with the present invention, the two v-shaped grooves can be dispensed with. As described above, the two grooves are disclosed in Japanese Patent Laid-Open Publication No. Hei 11-301759 and each serve as a bypass passage to permit the gas flow when the metering chamber is charged with the gas or when the gas container is refilled.

In the invention as claimed in claim 1, the invention as claimed in claim 2 is the gas spray valve in which grooves for holding the first and the second seal rings in place and for serving as the metering chamber are formed simply by partially enlarging a guide bore of the valve case to receive the valve pin, inserting into the enlarged portions of the bore components with simple construction that is formed separately from the valve case, and calking the valve case both at the upper end and the lower end thereof, rather than by forming grooves on an inner surface of the guide bore of the valve case.

In the invention as claimed in claim 1 and 2, the invention as claimed in claim 3 is one having a nozzle head attached to the top end of the valve pin. The nozzle head includes a stopper face for restricting the displacement of the valve pin to the first stop position.

In this manner, the gas is sprayed out from the gas container in constant amounts by pushing the nozzle head until istopped by the stopper face.

The present invention as claimed in claim 4 provides an injection adapter attached to the top end of the valve pin when gas is injected into the gas container through the gas spray valve as claimed in one of claims 1 to 3. The injection adapter includes a stopper face for restricting displacement of the valve pin to the second stop position.

In this manner, the gas can be injected into the gas container by pushing the injection adapter until stopped by the stopper face.

BEST MODE FOR CARRYING OUT THE INVENTION

Several embodiments of the present invention will now be described with reference to FIGS. 1 through 8.

First, a first embodiment of the present invention is described with reference to FIGS. 1, 2 and 3.

Figure 1:
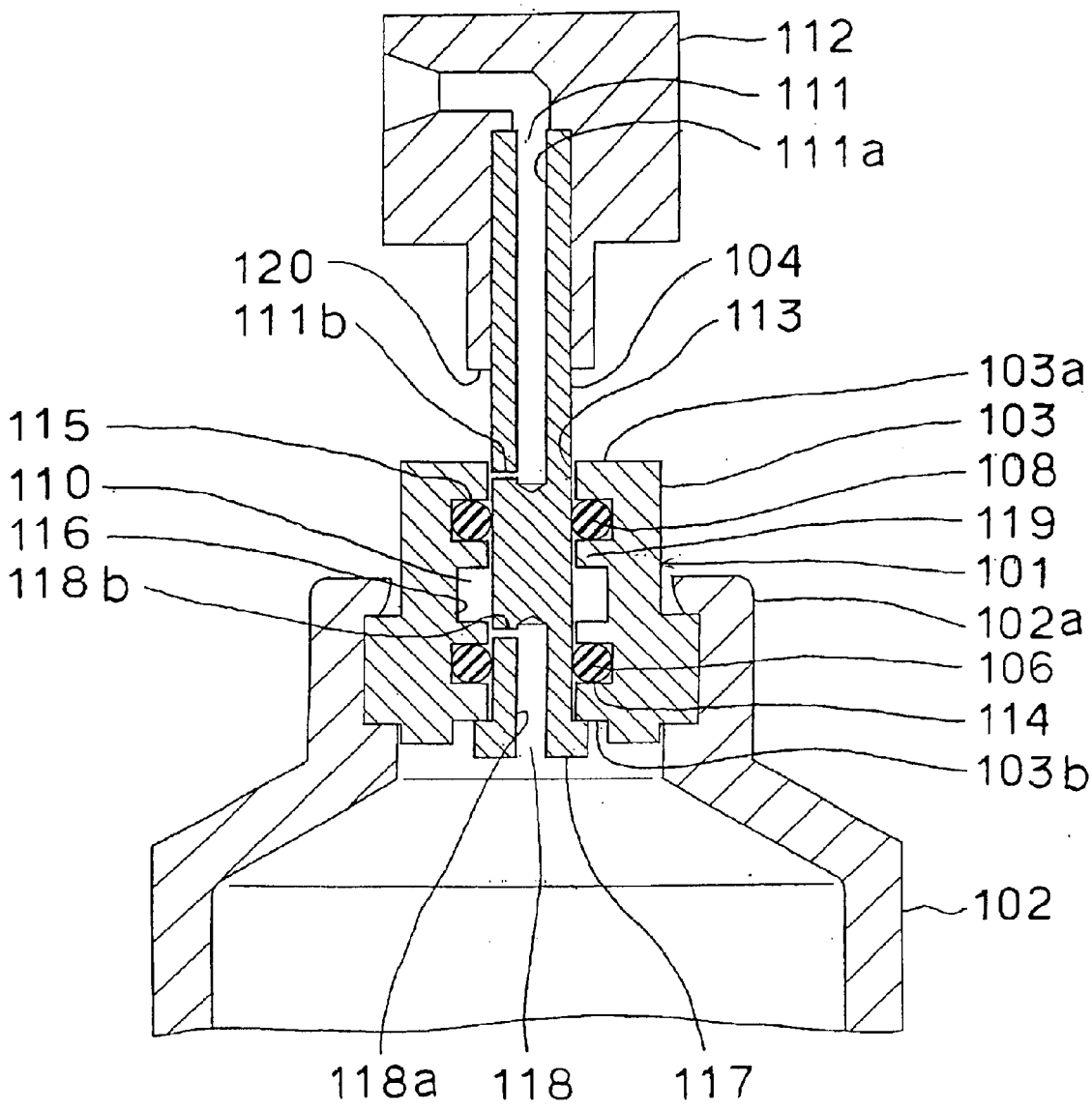
FIG. 1 is a cross-sectional view showing a first embodiment of a gas spray valve in accordance with the present invention.
Figure 2:
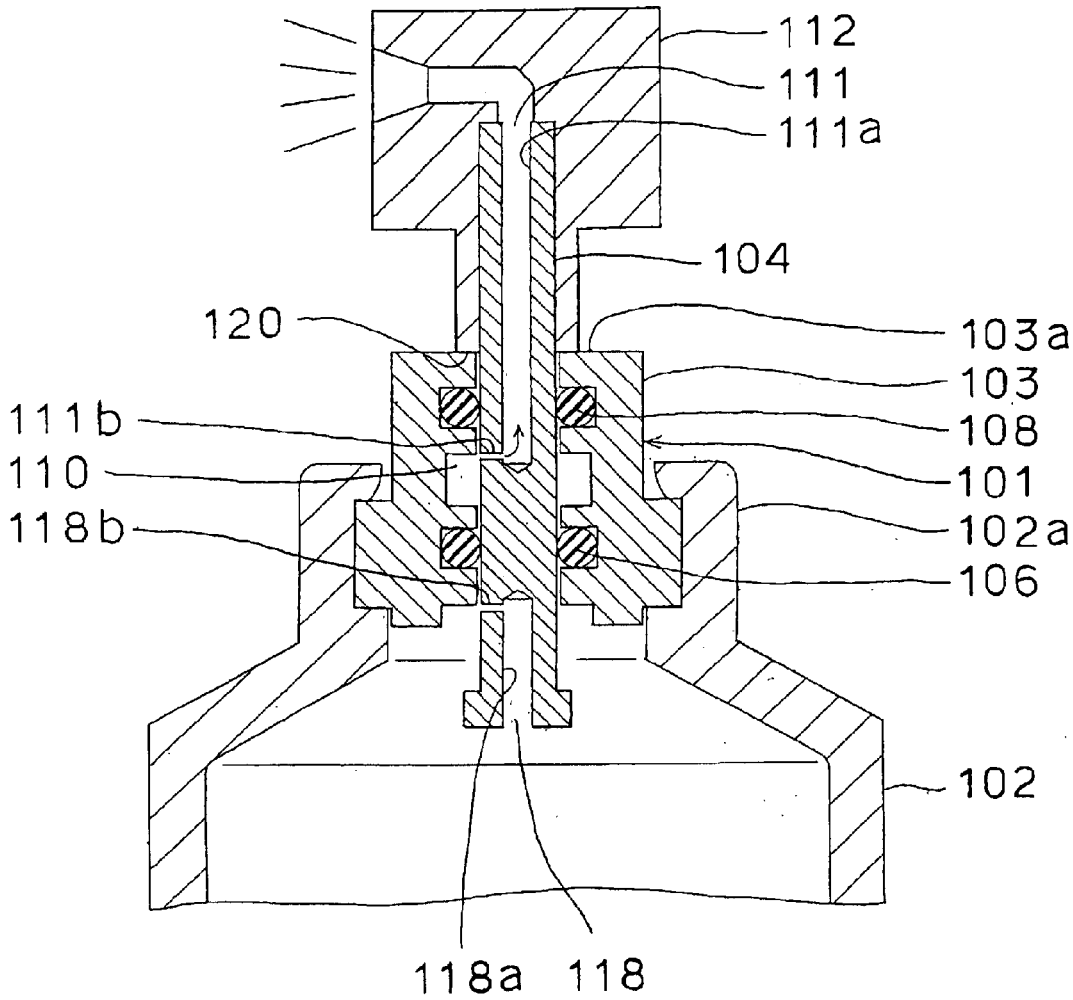
FIG. 2 is a cross-sectional view showing the same gas spray valve with a nozzle head pushed.
Figure 3:
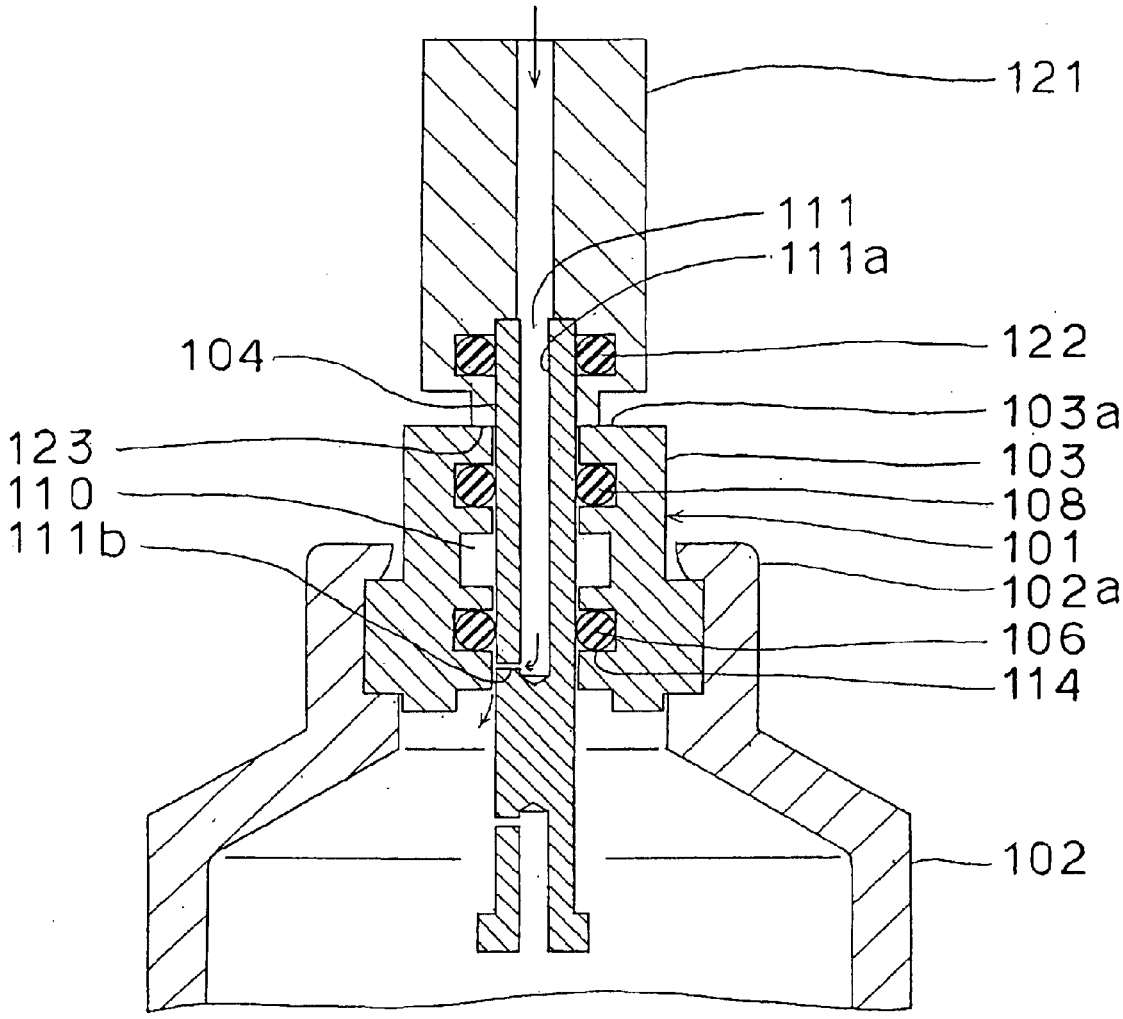
FIG. 3 is a cross-sectional view showing the same gas spray valve having an injection adapter attached thereto. The injection adapter is shown pushed to permit delivery of desired contents and high-pressure gas from a gas injector.

FIGS. 1, 2 and 3 show a spray apparatus employing a gas spray valve 101 in accordance with the present invention. The spray apparatus essentially consists of a gas container 102, which contains high-pressure gas such as liquid carbon dioxide along with desired contents such as a medical agent, and the gas spray valve 101 hermetically secured to an opening portion 102*a* of the gas container 102.

The gas spray valve 101 includes a valve case 103 secured by calking to the opening portion 102*a* of the gas container 102 and a valve pin 104 slidably retained in the valve case 103. A nozzle head 112 is secured to the valve pin 104 on the top end thereof projects above the valve case 103. The nozzle head serves both as a nozzle and as a push button.

The valve case 103 includes a guide bore 113 axially extending through the center thereof. The valve pin 104 is inserted through the guide bore 113. A pair of annular grooves 114 and 115 are formed on the inner surface of the guide bore 113 at a first position relatively close to the center of the gas container 102 and at a second position relatively far from the center of the gas container 102, respectively. The annular grooves 114 and 115 receive a first seal ring 106 and a second seal ring 108, respectively. The first seal ring 106 and the second seal ring 108 are each made of an elastic material. An annular recess 116 is formed in the guide bore 113 substantially at the center thereof. The annular recess 116 forms part of a space formed between the seal rings 106 and 108 that serves as a metering chamber 110 for trapping a predetermined volume of the gas before it is sprayed out.

The valve pin 104 includes a gas conduit 111 extending through a portion thereof that can project above the valve case 103. The gas conduit 111 opens in an end surface of the valve pin 104 and in the outer periphery of the valve pin 104 at a position axially apart from the end surface. Specifically, the gas conduit 111 consists of an axial bore 111*a* extending vertically from the end surface of the valve pin 104 and an orifice 111*b* extending radially from the bottom portion of the axial bore 111*a* to the outer periphery of the valve pin 104. The axial bore 111*a* has a relatively large diameter and the orifice 111*b* has a diameter smaller than that of the axial bore 111*a*. The orifice 111*b* determines the amount of gas sprayed out from the gas spray valve 101 per unit time. The size of the orifice must therefore be properly determined depending on the desired amount of the gas sprayed per unit time. The orifice 111*b* is arranged at the predetermined position on the periphery of the valve pin 104 such that it is positioned above the second seal ring 108 when the valve pin 104 is in its raised position, is positioned below the second seal ring 108 within the metering chamber 110 when the valve pin 104 is pushed into a first stop position, which will later be described, and is positioned below the first seal ring 106 within the gas container 102 when the valve pin 104 is pushed into a second stop position, which will also be described later.

The valve pin 104 includes at the bottom end thereof positioned within the gas container 102 a stopper flange 117, which abuts a bottom surface 103*b* of the valve case 103 to restrict upward displacement of the valve pin 104. The valve pin 104 acts upon by the pressure of the gas within the gas container 102 so that it is always urged upward.

The valve pin 104 further includes a gas supply passage 118 extending therethrough from the bottom end thereof positioned inside the gas container to a point on the outer periphery of the valve pin 104 axially apart from the bottom end. Specifically, the gas supply passage 118 consists of an axial bore 118*a* extending vertically from the bottom end of the valve pin 104 and a lateral bore 118*b* extending radially to connect the bottom portion of the axial bore 118*a* to the outer periphery of the valve pin 104. The lateral bore 118*b* is arranged at a position on the periphery of the valve pin 104 such that, with the valve pin 104 in the raised position, it is positioned above the first seal ring 106 within the metering chamber 110 so that the lateral bore 118*b,* together with the axial bore 118*a,* connects the interior of the gas container 102 to the metering chamber 110 inside the first seal ring 106.

The first stop position of the valve pin 104 is a relatively shallow position at which the valve pin 104 stops when the nozzle head 112 is pushed to spray the gas. Once the valve pin 104 has been pushed into the first stop position, further displacement of the valve pin 104 is restricted by mean of a stopper face 120, or the bottom surface of the nozzle head 112, abutting a top surface 103*a* of the valve case 103. The second stop position of the valve pin 104 is a relatively deep position at which the valve pin 104 stops when gas is injected from the top end of the valve pin 104 into the gas container 102. As shown in FIG. 3, upon injection of the gas, the nozzle head 112 is replaced by an injection adapter 121 of a gas injector, which restricts further displacement of the valve pin 104 once the valve pin 104 has been pushed into the second stop position. The injection adapter 121 includes a seal ring 122 that comes in close contact with the outer periphery of the valve pin 104 and a bottom surface to serve as a stopper face 123. The stopper face 123 abuts the top surface 103*a* of the valve case 103 to restrict further displacement of the valve pin 104 once the valve pin 104 has been pushed into the second stop position with the injection adapter 121 attached to the top end of the valve pin 104.

When the gas spray valve 101 constructed in the above-described manner is in its steady state without the nozzle head 112 being pushed, the valve pin 104, acted upon by the gas pressure within the gas container 102, is held in the raised position as shown in FIG. 1. In this state, the orifice 111*b* of the valve pin 104 is positioned above the second seal ring 108 to close communication between the gas conduit 111 and the metering chamber 110. Also, the lateral bore 118*b* provided in the lower portion of the valve pin 104 is positioned above the first seal ring 106 so that the metering chamber 110 communicates with the interior of the gas container 102 through the gas supply passage 118 including the lateral bore 118*b*.

When the nozzle head 112 is pushed, the lateral bore 118*b* in the lower portion of the valve pin 104 is displaced downward to below the first seal ring 106 as shown in FIG. 2, so that the first seal ring 106 closes communication between the interior of the gas container 102 and the metering chamber 110. Subsequently, the orifice 111*b* of the valve pin 104 moves to below the second seal ring 108 into the metering chamber 110 so that the predetermined amount of the gas and the contents within the metering chamber 110 is sprayed out from the gas container 102 through the gas conduit 111 of the valve pin 104. The downward displacement of the valve pin 104 is restricted to the first stop position by the stopper face 120 of the nozzle head 112 abutting the top surface 103*a* of the valve case 103.

When the gas container 102 is emptied of the gas and the contents through the use as described above, the nozzle head 112 is removed from the top end of the valve pin 104 and the injection adapter 121 of the gas injector is attached instead. The injection adapter 121 is then pushed until the stopper face 123 comes into contact with the top surface 103*a* of the valve case 103 as shown in FIG. 3 to allow the desired contents to be supplied from the gas injector along with high-pressure gas. The pushing motion of the injection adapter 121 causes the valve pin 104 to be displaced downward into the second stop position so that the orifice 111*b* is positioned below the first seal ring 106 and opens within the gas container 102. As a result, the gas conduit 111 of the valve pin 104 comes into communication with the interior of the gas container 102 through the orifice 111*b* to allow the contents and the gas supplied from the gas injector to be injected into the gas container 102.

Once injection of the gas and the contents into the gas container has been completed and the injection adapter 121 is released from the position for injection, the valve pin 104, acted upon by the gas pressure within the gas container 102, returns to the raised position so that the orifice 111*b* is positioned above the second seal ring 108 to close communication between the gas conduit 111 and the metering chamber 110. The injection adapter 121 is then removed from the top end of the valve pin 104 and the nozzle head 112 is mounted back on. This completes refill of the container with the gas and the contents.

In summary, the gas spray valve 101 in accordance with the present invention, despite its unusually simple structure, permits refill of the gas container 102 with the gas and the contents and thereby permits reuse of the gas container 102 and the gas spray valve 101. Thus, the gas spray valve can make efficient use of natural resources without a considerable increase in the production costs. Also, the gas spray valve 101 in accordance with the present invention dispenses with the v-shaped groove in the valve pin 104 such as that disclosed in Japanese Patent Laid-Open Publication No. Hei 11-301759. The v-shaped groove, formed on the valve pin to permit charging of the metering chamber with the gas or the like or to serve as a bypass passage for refilling the gas container with the gas and the contents, makes it necessary for the valve pin to have the preferred diameter of Φ2.5 or less to facilitate operation of the valve. As a result, the strength of the valve pin is reduced, as is its rigidity, making the valve pin susceptible to faulty operation or malfunction caused by bending and breaking of the valve pin by operative forces. Without such v-shaped grooves, the strength and the rigidity of the valve pin 104 are ensured in the gas spray valve 101 of the present invention, as is the reliable and safe operation of the valve pin 104.

Not requiring provision of the v-shaped groove, the valve pin can be manufactured through fewer processes using fewer tools, making the gas spray valve less expensive.

Figure 4:
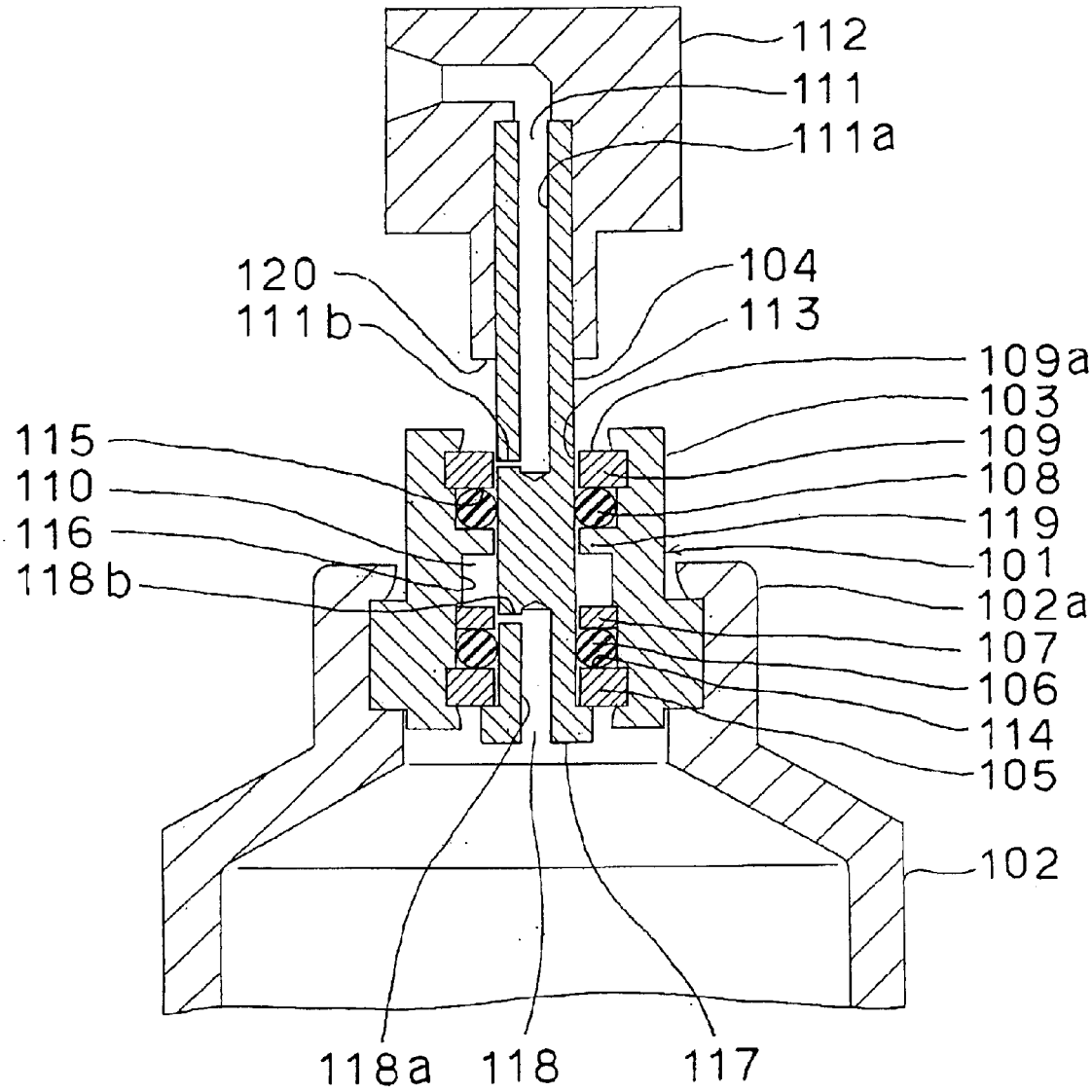
FIG. 4 is a cross-sectional view showing a second embodiment of the gas spray valve in accordance with the present invention.
Figure 5:
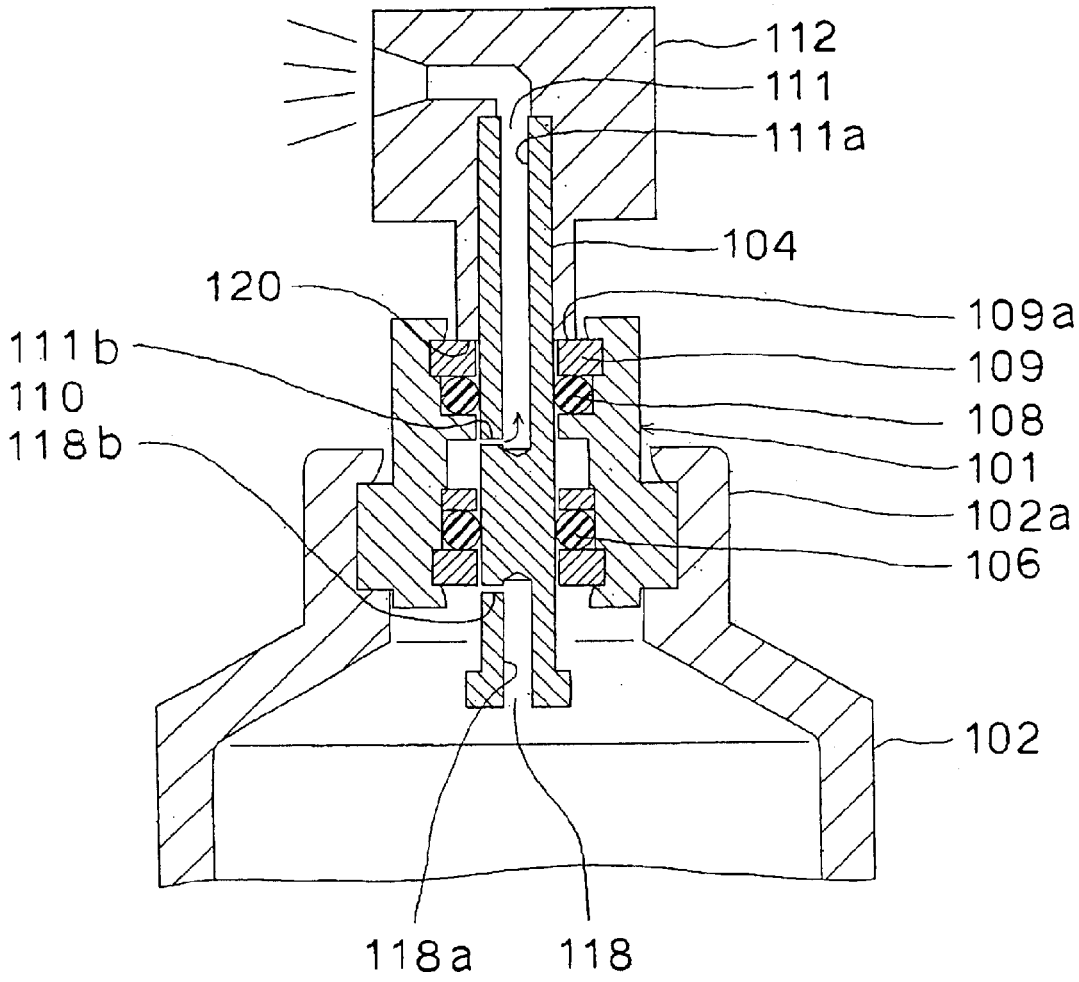
FIG. 5 is a cross-sectional view showing the same gas spray valve with a nozzle head pushed.
Figure 6:
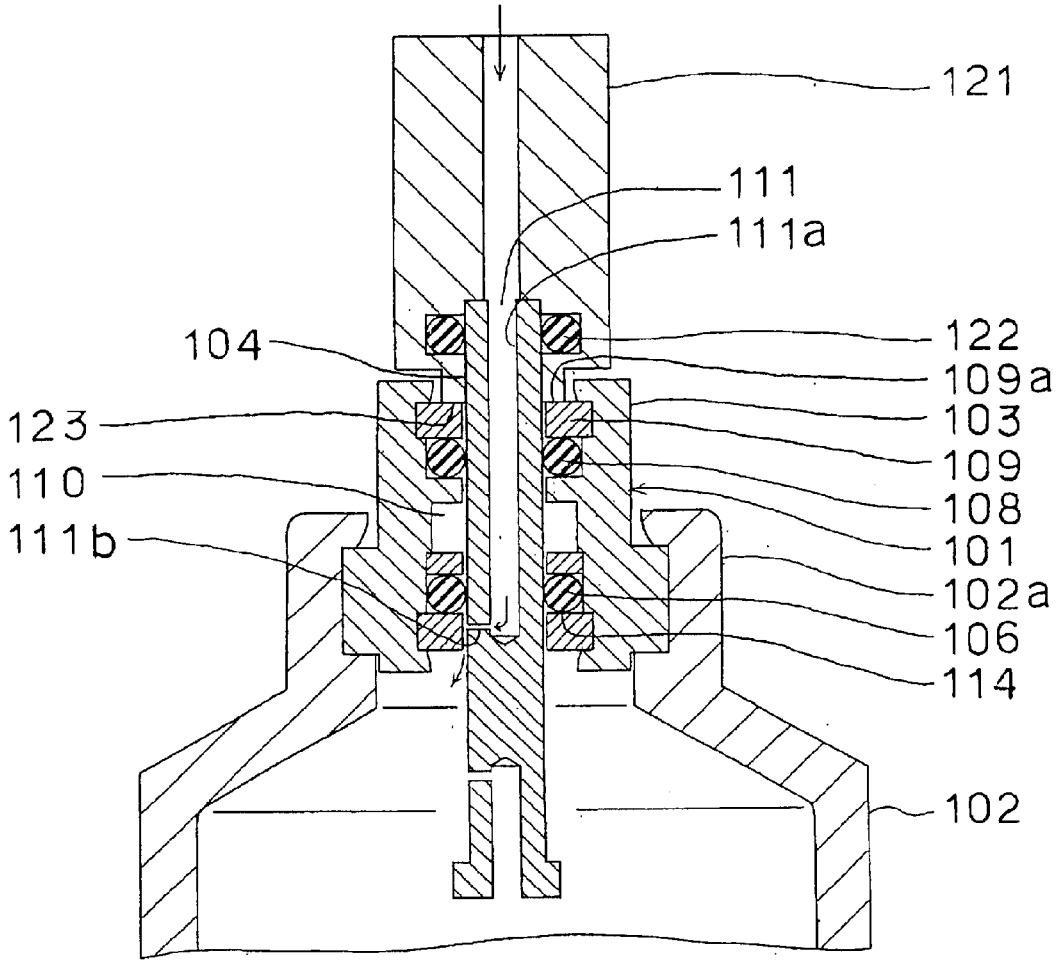
FIG. 6 is a cross-sectional view showing the same gas spray valve having an injection adapter attached thereto. The injection adapter is shown pushed to permit delivery of desired contents and high-pressure gas from a gas injector.
Figure 7:
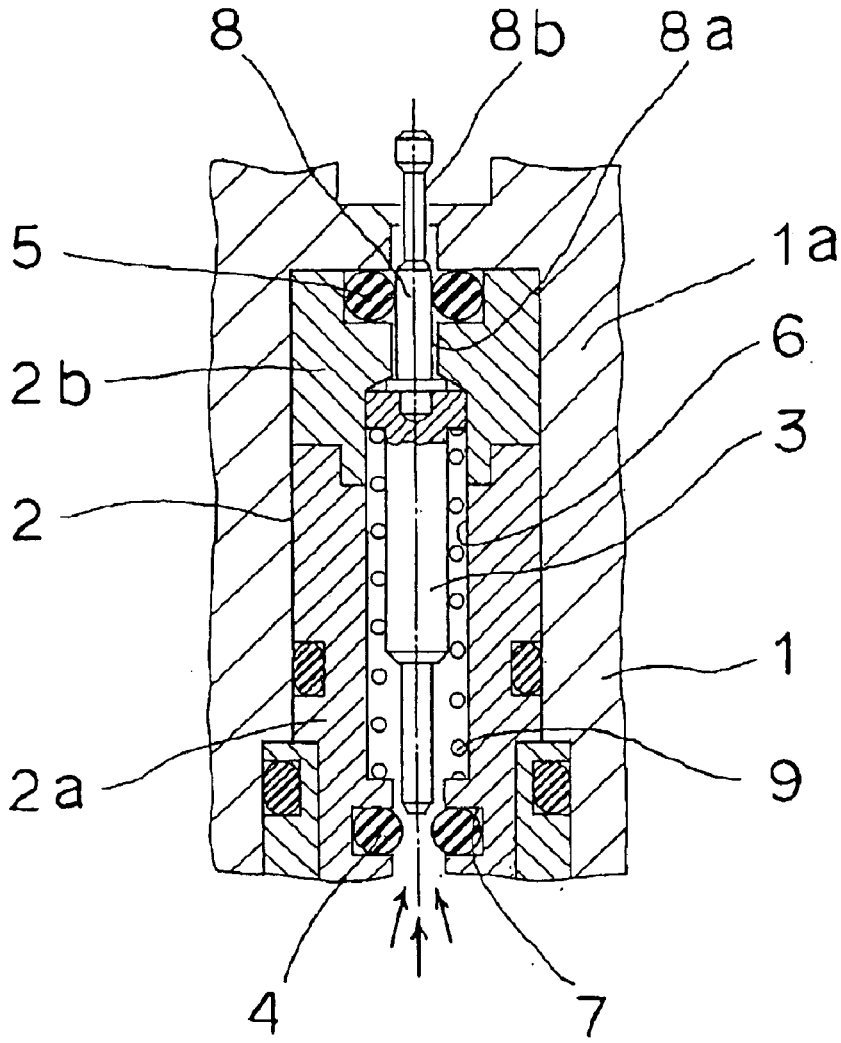
FIG. 7 is a cross-sectional view showing a conventional gas spray valve as prior art.
Figure 8:
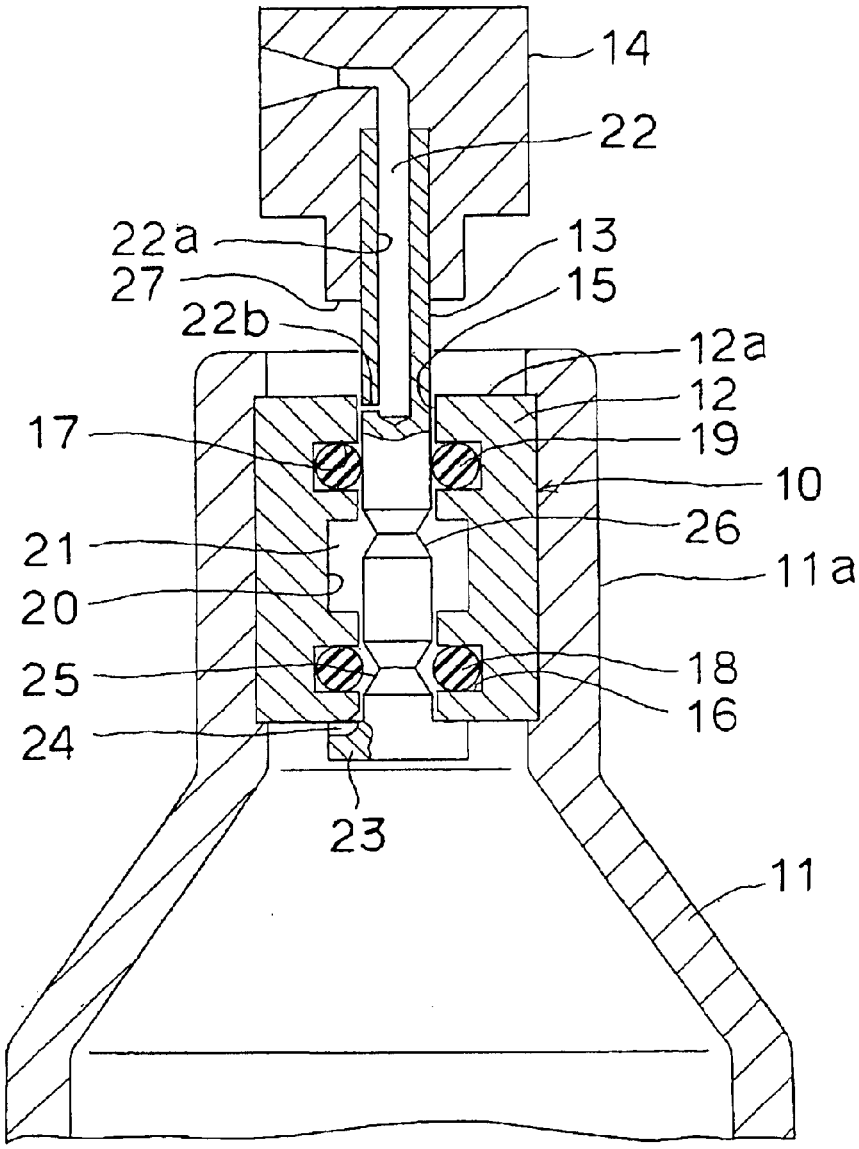
FIG. 8 is a cross-sectional view showing another type of conventional gas spray valve as prior art.

Next, a second embodiment of the present invention is described with reference to FIGS. 4, 5 and 6. Construction of this embodiment is essentially the same as that of the first embodiment described above with reference to FIGS. 1, 2 and 3, except for the annular groove 114 (first seal ring portion) and the annular groove 115 (second seal ring portion), each formed on the valve case 103, and the annular recess 116 to serve as the metering chamber 110.

In the following description, parts identical to those in the first embodiment are denoted by the same numerals, and description of these parts will not be repeated.

In the second embodiment of the present invention shown in each of FIGS. 4, 5 and 6, an annular groove 114 (a first seal ring portion) for receiving a first seal ring 106 is defined by a first seal ring guide A 105 placed below the first seal ring 106 and a first seal ring guide B 107 placed above the first seal ring 106. A valve case 103 is calked at a lower end 103*b* to secure the first seal ring guide A 105. Likewise, an annular groove 115 (a second seal ring portion) for receiving a second seal ring 108 is defined by an annular rib 119 placed below the second seal ring 108 and formed as a part of the valve case 103, and a second seal ring guide 109 placed above the second seal ring 108. The valve case 103 is calked at an upper end 103*a* to secure the second seal ring guide 109. An annular recess 116 to serve as a metering chamber is also defined by the annular rib 119 of the valve case 103 and the first seal ring guide B 107.

Unlike the gas spray valve of the first embodiment, in which grooves must be formed inside the guide bore of the valve case 103 to receive the valve pin 104 so that they can serve as the annular grooves 114 and 115 and as the annular recess 116, or the metering chamber 110, the gas spray valve in this embodiment does not require formation of technically demanding groove features and can be constructed simply by boring into the valve case 103 from either end thereof, inserting into the bore the first seal ring guide A 105 or other simple components that are formed separately, and then calking the valve case 103 both at the upper end 103*a* and at the lower end 103*b* thereof. Such simple construction of the gas spray valve of the second embodiment not only contributes to the productivity during production, but also permits a significant cost reduction.

Industrial Applicability

As set forth, the invention as claimed in claim 1 provides a novel spray gas valve including a valve pin having a gas conduit extending therethrough from a top end thereof that is positioned outside the gas container to a point on the outer periphery thereof that is axially apart from the top end. An opening of the gas conduit on the outer periphery of the valve pin is arranged such that it is positioned above the second seal ring when the valve pin is in its raised position and it is positioned below the second seal ring within the metering chamber when the valve pin is pushed into a first stop position. The valve pin further includes a gas supply passage extending from a bottom end thereof that is positioned within the gas container to a point on the outer periphery of the valve pin that is axially apart from the bottom end. An opening of the gas supply passage on the outer periphery of the valve pin is arranged such that, when the valve pin is in the raised position, it is positioned above the first seal ring within the metering chamber. The opening of the gas conduit on the outer periphery of the valve pin is positioned below the first seal ring within the interior of the gas container when the valve pin is further pushed into a second stop position. In this manner, the predetermined amount of the gas trapped in the metering chamber is sprayed out from the gas container through the gas conduit of the valve pin by pushing the valve pin into the first stop position. In addition, by pushing the valve pin further into the second stop position with the gas injector connected to the top end of the valve pin, the gas conduit is brought into communication with the interior of the gas container so that the gas can be injected into the gas container in a reliable manner.

Thus, despite its unusually simple structure, the present invention permits recharging of the gas container of the used spray apparatus through the gas spray valve and thereby permits reuse of the gas container and the gas spray valve. Ultimately, the gas spray valve according to the present invention facilitates efficient use of natural resources without a considerable increase in the production costs.

As disclosed in Japanese Patent Laid-Open Publication No. Hei 11-301759, the v-shaped groove, which is formed on the valve pin to permit charging of the metering chamber with the gas or the like or to serve as a bypass passage for refilling the gas container with the gas and the contents, makes it necessary for the valve pin to have the preferred diameter of Φ2.5 or less to facilitate operation of the valve. As a result, the strength of the valve pin is reduced, as is its rigidity, making the valve pin susceptible to faulty operation or malfunction caused by bending and breaking of the valve pin by operative forces. However, the gas spray valve in accordance with the present invention, which dispenses with the v-shaped groove in the valve pin, can ensure the strength and the rigidity of the valve pin, thereby ensuring reliable and safe use of the valve pin.

Not requiring provision of the v-shaped groove, the valve pin can be manufactured through fewer processes using fewer tools, making the gas spray valve less expensive.

In the invention as claimed in claim 1, the invention as claimed in claim 2 provides the grooves for holding the first and the second seal rings in place and for serving as the metering chamber, formed simply by partially enlarging a guide bore of the valve case to receive the valve pin, inserting into the enlarged portions of the bore components with simple construction that is formed separately from the valve case, and calking the valve case both at the upper end and the lower end thereof, rather than by forming technically demanding grooves inside on an inner surface of the guide bore of the valve case to receive the valve pin. Such simple construction is of sufficient strength and can readily be manufactured. This leads to increased productivity, and thus, to a significant cost reduction.

In the invention as claimed in claim 1 or 2, the invention as claimed in claim 3 provides a nozzle head to be attached to the top end of the valve pin including a stopper face for restricting the displacement of the valve pin to the first stop position. In this manner, during normal use, the gas is always sprayed out from the gas container in constant amounts by simply pushing the nozzle head until stopped by the stopper face.

The invention as claimed in claim 4 is an injection adapter attached to the top end of the valve pin when gas is injected into the gas container through the above-described gas spray valve in accordance with the invention as claimed in one of claims 1 to 3. The injection adapter includes a stopper face for restricting displacement of the valve pin to the second stop position. In this manner, the gas can be injected into the gas container in a reliable manner by simply attaching the injection adapter to the top end of the valve pin and pushing the injection adapter until stopped by the stopper face.

What is claimed is:

1. A gas spray valve, comprising a valve case secured to an opening portion of a gas container; a valve pin slidably received in the valve case; a first seal ring and a second seal ring arranged within the valve case, the first seal ring coming into close contact with an outer periphery of the valve pin at a first position that is relatively close to the center of the gas container, the second seal ring coming into close contact with the outer periphery of the valve pin at a second position that is relatively far from the center of the gas container; and a metering chamber formed between the first seal ring and the second seal ring to trap a predetermined amount of gas prior to spraying, the gas spray valve wherein, the valve pin includes a gas conduit extending therethrough from a top end thereof that is positioned outside the gas container to a point on an outer periphery thereof that is axially apart from the top end, with an opening of the gas conduit on the outer periphery of the valve pin being arranged such that it is positioned above the second seal ring when the valve pin is in its raised position, it is positioned below the second seal ring within the metering chamber when the valve pin is pushed into a first stop position, and it is positioned below the first seal ring within the gas container when the valve pin is pushed into a second stop position; the valve pin further includes a gas supply passage extending from a bottom end thereof that is positioned within the gas container to a point on the outer periphery that is axially apart from the bottom end, an opening of the gas supply passage on the outer periphery of the valve pin being arranged such that, when the valve pin is in the raised position, it is positioned above the first seal ring within the metering chamber to open communication between the interior of the gas container and the metering chamber.

2. The gas spray valve as claimed in claim 1, wherein grooves for holding the first seal ring and the second seal ring in place and for serving as the metering chamber are formed simply by partially enlarging a guide bore of the valve case to receive the valve pin, inserting into the enlarged portions of the bore components with simple construction that is formed separately from the valve case, and calking the valve case both at the upper end and the lower end thereof, rather than by forming grooves on an inner surface of the guide bore of the valve case.

3. The gas spray valve as claimed in claim 1 or 2, wherein the gas spray valve further comprises a nozzle head attached to the top end of the valve pin, and the nozzle head includes a stopper face for restricting the displacement of the valve pin to the first stop position.

4. The gas spray valve as claimed in claim 1, further comprising an injector adapter attached to the top end of the valve pin wherein the injection adapter includes a stopper face for restricting displacement of the valve pin to the second stop position.

* * * * *